United States Patent [19]

Orenstein

[11] 4,312,151

[45] Jan. 26, 1982

[54] CONTROLLABLE RESPONSE SYSTEMS

[76] Inventor: Henry Orenstein, 136 Lakeside Ave., Verona, N.J. 07044

[21] Appl. No.: 189,048

[22] Filed: Sep. 22, 1980

Related U.S. Application Data

[63] Continuation-in-part of Ser. No. 11,446, Feb. 12, 1979, abandoned.

[51] Int. Cl.[3] ..... A63H 33/36

[52] U.S. Cl. ..... 46/240

[58] Field of Search ..... 46/240, 238, 239; 33/235

[56] References Cited

U.S. PATENT DOCUMENTS

| | | | |
|---|---|---|---|
| 2,651,140 | 9/1953 | Kovac | 46/240 |
| 2,791,065 | 5/1957 | Stanetzki | 46/240 |
| 2,929,144 | 3/1960 | Mellema | 33/23 R |
| 3,392,262 | 7/1968 | Hansen et al. | 33/25 R |
| 3,481,071 | 12/1969 | Hinkson | 46/240 |
| 3,584,410 | 6/1971 | Lalonde | 46/238 |
| 3,625,516 | 12/1971 | Handweiler | 46/240 |
| 3,629,971 | 12/1971 | Antell et al. | 46/240 |

OTHER PUBLICATIONS

"The Way Things Work", vol. II, Pub. by Simon & Schuster, N.Y., N.Y. 10020; ©1971, pp. 202–203.

*Primary Examiner*—F. Barry Shay

*Attorney, Agent, or Firm*—George E. Kersey

[57] ABSTRACT

Controllable response systems for providing remote control over one or more toy objects, such as a miniature toy vehicle, on a playing surface. A linkage mechanism beneath the playing surface has an end which is accessible to an operator and is used to manipulate another end, beneath the surface, which is magnetically coupled to the object being controlled. The linkage mechanism is adjustable to control the relationship between the area of movement of the end accessible to an operator and the area of the playing surface over which the toy object is moved.

8 Claims, 2 Drawing Figures

CONTROLLABLE RESPONSE SYSTEMS

This is a continuation-in-part of Ser. No. 011,446 filed Feb. 12, 1979, now abandoned.

BACKGROUND OF THE INVENTION

This invention relates to the remote control of toy objects, and, more particularly, to the remote control of toy objects on a playing surface.

Children frequently play with toys where an action at one location produces a related response at another location. One such device is provided by a playing surface on which the movement of an object, such as a toy vehicle, is controlled by a steering wheel or a stick positioned at one edge of the surface.

Unfortunately the device makes use of relatively complex mechanisms and electrical circuitry. Thus the action of the operator is converted into an electrical signal which acts upon associated mechanisms to produce the desired response. Such a device is cumbersome and expensive.

In addition, it is limited in its ability to respond to the dictates of the user. In one such type of device the toy vehicles that are remotely controlled are confined to a particular track, and are difficult to reverse in direction.

Accordingly, it is an object of the invention to facilitate the indicated remote control of toy objects. A related object is to achieve indicated remote control without the need for electric motors and attendant electrical circuitry.

Another object of the invention is to simplify the mechanism used in providing the remote control of toy objects. A related object is to achieve indicated remote control using entirely a simplified mechanical mechanism.

A further object of the invention is to increase the flexibility of devices which provide for the manipulation of toy vehicles on a playing surface.

A related object is to enhance the degree of which an operator can vary the movement on a playing surface of a remotely controlled object. Still another related object is to permit relatively instantaneous reverses of motion of remotely controlled objects on a playing surface.

SUMMARY OF THE INVENTION

In accomplishing the foregoing and related objects, the invention provides a playing surface for toy objects that are magnetically coupled to one end of a linkage mechanism beneath the playing surface and has another end accessible to an operator. This gives the appearance that the object is remotely controlled by the operator.

In accordance with one aspect of the invention the magnetically coupled end of the linkage mechanism is spring-loaded against the underside of the playing surface, to enhance the magnetic coupling between it and the toy object being manipulated.

In accordance with another aspect of the invention, the magnetic coupling makes use of a magnet and an element which is responsive to magnetomotive force, i.e. one made from magnetic material. The magnet may be at the end of the arm beneath the playing surface, or it may be in the object that is being manipulated.

In accordance with another aspect of the invention, the linkage mechanism has a set of links which provide a magnification at the magnetic end of movement initiated to the remote control end.

In accordance with still another aspect of the invention, the mechanism is formed by four links, the first of which has an end at a fixed pivot position with respect to the base of the structure and the remaining members are pivotally affixed one to another, with one of the links extending to the magnet couple and other being connected to a controller at the accessible position.

In accordance with still another aspect of the invention, the accessible end of the mechanism is provided in a cut-out at one extremity of the playing surface. A shield is placed over at the cut-out to conceal the actual linkages and thus enhance the remote control effect that is provided.

DESCRIPTION OF THE DRAWINGS

Other aspects of the invention will become apparent after considering several illustrative embodiments taken in conjunction with the drawings in which.

DETAILED DESCRIPTION

Figure 1:
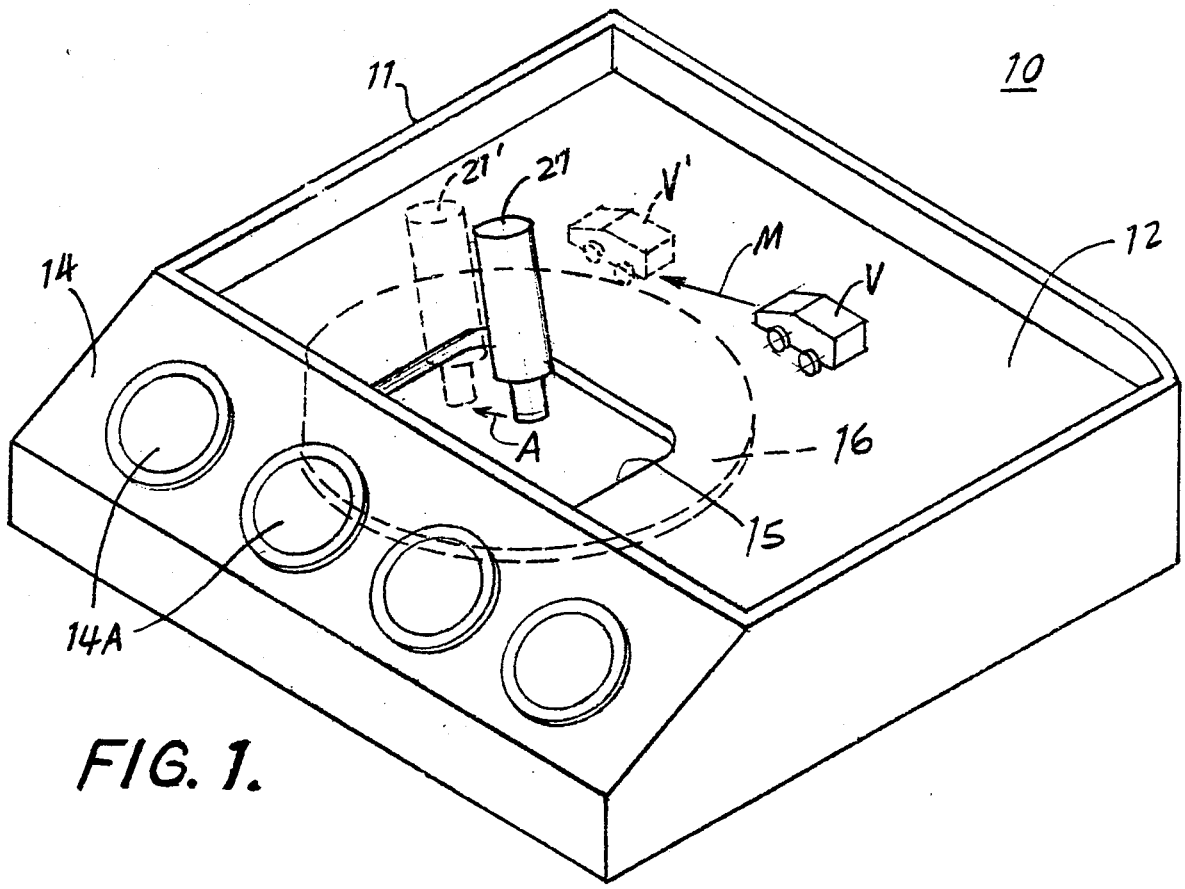
FIG. 1 is an overall perspective view of a remote control simulation device in accordance with the invention.

With reference to the drawings, a remote control simulation toy 10 is formed by a frame 11 having upper playing surface 12, base 13 and a front panel 14. The latter includes illustrative instrument sockets 14A to enhance the control effect.

Figure 2:
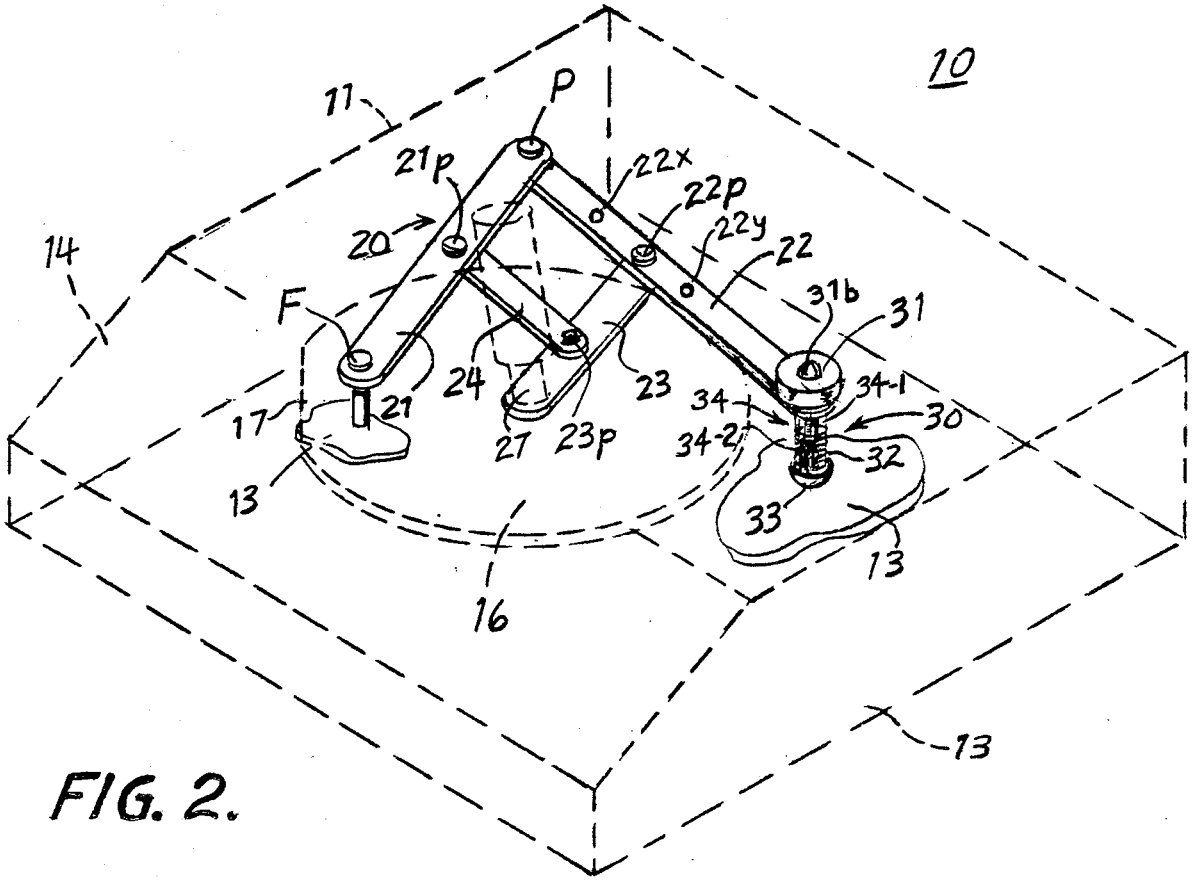
FIG. 2 is a perspective view of the control mechanism for the device of FIG. 1.

Positioned on the playing surface 12 is a toy object, such as a vehicle V, which is remotely manipulated using a control knob 27 of a control mechanism 20 (FIG. 2).

As indicated in FIG. 1, when the user manipulates the control knob 27, for example, by moving it to the phantom position 27' in the direction indicated by the arrow A, and the mechanism that extends from the control knob 27 beneath the playing surface 12 is magnetically coupled to the vehicle V to bring about a corresponding movement of the vehicle V, for example, to the phantom position V' along the direction indicated by the arrow M. It is to be noted that the path of the vehicle V marked by the arrow M is a magnified replica of the path of the control knob 27 indicated by the arrow A.

Accordingly the device 10 permits the operator to accurately control the position of the vehicle V in accordance with the position and path provided by the operator for the control knob 27.

In order to permit the desired manipulation of the control knob 27 with respect to the entire playing surface 12, a cut-out 15 is provided in which the movement of the control knob 27 is confined. The linkage mechanism connected to the control knob 27 is concealed by a shield 16 which is connected to the control knob and underlies that part of the playing surface 12 adjoining the cut-out 15.

An illustrative mechanism 20 for accomplishing the remote control effect is shown in FIG. 2. The mechanism 20 is formed by a set of pivoted linkages 21, 23, 23 and 24 that extend from a fixed pivot F with respect to the base 13 of the housing 10, to an end with a coupling assemblage 30. The control knob 27 is connected to the free end of an intermediate link 23, between the fixed pivot F and the coupling assemblage 30.

For the particular mechanism 20 of FIG. 2 which has four links 21 and 23, and 22 and 24, the linkage 21 is pivoted to the linkage 22 at an end pivot point P, and at an intermediate pivot point 21*p* to the linkage 24. The linkages 22 and 24 are joined by the third linkage 23 which is connected at an intermediate pivot point 22*p* to the linkage 22, and at an end pivot point 23*p* to the linkage 24. The control knob 27 is rotatably affixed at the free end of the linkage 23. The other free end of the mechanism, i.e. at the otherwise unconnected end of the linkage 22 terminates in the magnetic coupling assemblage 30.

The coupling asemblage 30 includes a magnetically permeable member 31 affixed to the linkage 22 and supported against the lower side of the playing surface 12 by a spring 32. The latter is interposed between the linkage 22 and a slide member 33 that is used merely to facilitate the movement of the linkage 22 with respect to the base 13.

To facilitate the movement of the disc member 31 against the underside of the surface 12, it includes a socket containing a rotatable member such as a ball bearing 31*b*. The slide 33 has a telescoping axle 34 with an inner part 34-1 that is connected to the linkage 22 and an outer part 34-2 that is connected to a flat upper surface of the slide 33 which in the form of a hemisphere with its rounded lower portion in sliding engagement with the base 13. Appropriate separation of the inner and outer parts 34-1 and 34-2 of the axle 34 is maintained by the coil spring 32 which envelopes the axle 34 between the lower side of the link 22 and the upper side of the slide 33.

The connections 21*p*, 22*p* and 23*p* are adjustable. In particular, the connection 22*p* is formed by a screw with a threaded lower end (not visible in FIG. 2). To reduce the area of manipulation in the cut-out 15 for the control knob 27 the connection of the link 23 to the link 22 is moved to position 22*x*, with the connector at position 22*p* removed, the arm 23 shifted and the converter reapplied at position 22*x* after the apertured end of the link 23 has been aligned with the aperture 22*x*.

Conversely, to enlarge and shift the area of manipulation of the knob 27, the link 23 is moved and reconnected to the link 22 at the position 22*y*. In this case, as in the case where the link is at position 22*x*, the linkages form a non-parallelogram configuration.

In addition the cover disc 16 which is mounted on the link 23 to rotate about the neck of the control knob 27 has a flat edge 17. This provides a definite starting point for the movement of the knob 27, when the edge 17 is against a wall of the frame 11.

The location of the fixed pivot F depends upon the desired relation between the manipulated position of the control knob 27 in the cut-out 15 and the surface 12. When the playing surface is centrally located, the pivot F is also centrally located, but displaced away. When the playing area is on the right the pivot F is located on the left of the base 13, and on the right when the playing area is on the left.

The movement of the control knob 27 is reproduced similarly, but in magnified form, by the coupling assemblage 30. For the particular mechanism 23, the magnification is given by the ratio of the distance between the fixed pivot F and the assemblage 30 to the distance between fixed pivot F and the point of connection of the control knob 26 to the linkage. It will be understood that the magnification may be changed by altering the distance ratio discussed above. In addition to the intermediate pivot points 21*p*, 22*p* and 23*p* may be adjusted as desired.

Also visible in FIG. 3 is the outline of the shield 16 which is approximately centered on the control knob 27. It will be appreciated that the shield may have a wide variety of other forms and dispositions.

While various aspects of the invention have been set forth by the drawings and specification, it is to be understood that the foregoing detailed description is for illustration only and that various changes in parts, as well as the substitution of equivalent constituents for those shown and described may be made without departing from the spirit and scope of the invention as set forth in the appended claims.

What is claimed is:

1. A toy for providing remote control over a miniature toy vehicle comprising a frame having a base and an upper playing surface thereon;

a linkage mechanism mounted on said base beneath said playing surface extending to a control knob;

a toy vehicle on said playing surface;

a cut-out in said playing surface for confining the movement of said control knob;

means carried by said control knob including a shield covering said linkage mechanism in the area of said cut-out and underlying that part of the playing surface adjoining said cut-out for concealing the linkage mechanism connected to said control knob;

said linkage mechanism being formed by a set of four pivoted links, a fixed pivot pivotally securing one end of one of said links to said base, said linkage extending therefrom to an assemblage for coupling said mechanism to said toy vehicle;

said control knob being connected to the free end of an intermediate link between said fixed pivot and coupling assemblage, and projecting through said cut-out;

said coupling assemblage including a magnetically permeable member fixed to one of said links and supported against the lower side of said playing surface by a spring which is interposed between the link connected to said assemblage and a slide member.

2. A toy as defined in claim 1 wherein said slide member has a spherical lower surface for facilitating the movement of the link to which said assemblage is connected and an upper surface that is adapted for receiving said spring; said spring is a coil member extending from the receiving surface of said slide member to the connection of said magnetically permeable member with its link.

3. A toy as defined in claim 1 wherein said magnetically permeable member is in the form of a cylindrical disc.

4. A toy as defined in claim 2 wherein said coil spring contains a plurality of turns for providing pressure so that said magnetically permeable member makes suitable contact with the lower playing surface to magnetically engage said toy vehicle.

5. A toy as defined in claim 1 wherein said linkage mechanism contains pivots which are selectively adjustable.

6. A toy as defined in claim 5 wherein said pivots can be adjusted to form a non-parallelogram configureation of the constituent links thereof.

7. A toy as defined in claim 1 wherein said control knob is readily affixed at a free end of one of the constituent links of said linkage mechanism.

8. A toy as defined in claim 1 wherein said mechanism comprises four links, one being adjustable, that are pivotally joined to one another.

* * * * *